US005902140A

United States Patent [19]

Cheung et al.

[11] Patent Number: 5,902,140

[45] Date of Patent: May 11, 1999

[54] CHILD-SAFE POWER STRIP

[75] Inventors: Samuel Cheung; Leny N. Y. Heung, both of Hong Kong, The Hong Kong Special Administrative Region of the People's Republic of China

[73] Assignee: Recoton Corporation, Lake Mary, Fla.

[21] Appl. No.: 08/939,320

[22] Filed: Oct. 1, 1997

[51] Int. Cl.[6] ..... H01R 13/44

[52] U.S. Cl. ..... 439/139; 174/67

[58] Field of Search ..... 439/139, 143; 174/66, 67

[56] References Cited

U.S. PATENT DOCUMENTS

| | | | |
|---|---|---|---|
| 2,119,428 | 5/1938 | Englar | 174/67 |
| 2,154,160 | 4/1939 | Hamilton | 439/139 |
| 2,336,218 | 12/1943 | Blinn | 439/137 |
| 2,507,654 | 5/1950 | Stubbs | 439/145 |
| 2,515,003 | 7/1950 | Hamilton | 439/139 |
| 2,515,870 | 7/1950 | Hamilton | 439/139 |
| 2,524,250 | 10/1950 | Bierce | 439/139 |
| 2,545,536 | 3/1951 | Von Holtz | 439/137 |
| 2,553,837 | 5/1951 | Von Holtz | 439/137 |
| 2,579,538 | 12/1951 | Bierce | 439/137 |
| 2,740,943 | 4/1956 | Young | 439/137 |
| 2,752,581 | 6/1956 | Benander | 439/139 |
| 3,113,174 | 12/1963 | Spiteri | 174/67 |
| 3,222,631 | 12/1965 | Cohen | 439/137 |
| 3,238,492 | 3/1966 | Houston | 439/137 |
| 3,363,215 | 1/1968 | Smith | 439/139 |
| 3,736,547 | 5/1973 | Koenig | 439/93 |
| 4,072,382 | 2/1978 | Reschke | 439/143 |
| 4,584,430 | 4/1986 | Belknap | 174/67 |
| 5,267,870 | 12/1993 | Maresh | 439/139 |

FOREIGN PATENT DOCUMENTS

| | | |
|---|---|---|
| 496926 | 1/1951 | Belgium . |
| 727740 | 4/1955 | United Kingdom . |

*Primary Examiner*—Neil Abrams
*Assistant Examiner*—T C Patel
*Attorney, Agent, or Firm*—Levisohn, Lerner, Berger & Langsam

[57] ABSTRACT

A power strip that is resistant to the tampering of children is provided. The power strip includes a non-conductive housing and multiple electrical sockets. In front of each socket is a non-conductive plate with holes corresponding to the holes of the outlet. The plate is spring-biased into a first position so that the holes in the plate are out of alignment with the holes in the socket to prevent a child from inserting anything into the socket. A non-conductive barrier is disposed between the spring that biases the plate and the conductors that connect the sockets together to prevent inadvertent contact between the spring and the conductors. A depression is formed in the housing so that, when the prongs of a standard three-prong plug are inserted into the holes of the plate to rotate the plate, all three prongs will make contact with the plate and rotation thereof will be facilitated. The power strip may include a surge protector as well.

18 Claims, 8 Drawing Sheets

10
12
14
16
18
18
18
20
20
22
26
200
102
104
106
2
2
3
3

200
210
220
27
26
10
22
20
22
21
22
14
62
64
70
66
24
44
80
60
40
50
42

CHILD-SAFE POWER STRIP

BACKGROUND OF THE INVENTION

1. Field of the Invention

The invention relates to power strips, and more particularly to multiple outlet power strips that are tamper-resistant so as to prevent children from injury.

2. Description of Related Art

Power strips are commonly employed electrical devices for enabling several appliances to be operated from a single power source. A common power strip has a plug, for plugging into the power source, and multiple outlets. The plugs from each of the appliances are inserted into the outlets of the power strip and all can be used simultaneously.

Surge protectors or suppressors are common electrical devices which prevent sensitive electrical appliances and equipment (such as computers and audio systems) from being harmed by sudden spikes in voltage. A voltage surge is typically considered to be a transient wave of voltage on the power line, having an amplitude of up to several thousand volts and a duration of between 1–100 milliseconds. Common effects of voltage spikes are damage to electronic components and/or loss of data and programs in computer memories. Voltage spikes can be caused by a number of events, such as lightning striking power lines, switching of transmission lines by electrical utilities, or rapid connections or disconnections of large loads on the same line. The surge protector acts as a buffer and limits the peak voltage applied to an electronic device to a level which will not harm the device. Surge protectors typically employ a clipping circuit for this purpose.

The physical structure of a surge protector typically includes a non-conductive housing having a number of electrical sockets formed therein. The sockets typically are linked by common conductors and are formed in a row. The most common type of surge protector includes one row of sockets and is sometimes referred to as a power strip.

In households having small children, electrical outlets are commonly childproofed for safety reasons. If an electrical outlet is left exposed, small children are able to inadvertently or intentionally insert electrically conductive objects into the outlet. Such action may have a deleterious effect on both the children and the electrical system of the house; the electrical system may short out, and the children may be injured or electrocuted.

Typically, a plastic plug is inserted into an outlet to childproof it. This prevents the insertion of another object. However, when it is desired to use the outlet, the plastic plug must be removed. It is not uncommon to lose the plug during the use of the outlet and then not be able to replace the plug in the outlet afterwards.

Electrical outlets have been developed that have child safety features integrally formed therein. One common design includes a cap which is pivotally mounted on top of the outlet. In order to use the outlet, the cap must be flipped up to expose the socket. Another common design entails placing a rotatable nonconductive plate over the socket. The plate has holes which correspond to the socket. However when the outlet is not in use, the plate is biased in a position where the holes in the plate do not align with the holes of the socket. When it is desired to use the outlet, the plate is rotated or slid so as to align the plate holes with the outlet holes. Typically, the plate is mounted to the socket and biased with a torsion spring. Such an arrangement is depicted in, for example, U.S. Pat. Nos. 2,154,160 to Hamilton and 2,752,581 to Benander. Use of torsion springs is not, however, a perfect solution, as they are prone to break.

Another childproof outlet is described in U.S. Pat. No. 4,584,430 to Belknap. Belknap describes a plate mounted in front of a socket having radially extending arms disposed on opposing sides of the plate. Nonconductive linearly resilient bands such as rubber bands are attached to these arms and also attached to fixed points on the housing. The rubber bands bias the plate in a position where the holes of the plate are not aligned with the holes of the socket. This outlet suffers from the deficiency that rubber bands are prone to become brittle with age and use.

A similar outlet is described in U.S. Pat. No. 2,524,250 to Bierce. In this reference, a plate is rotatably mounted in front of a socket and is provided with holes corresponding to the holes in the socket. A coil spring biases the plate in a position where the holes of the plate are not aligned with the holes of the socket. The spring is disposed in an arcuate slot and is bent in an arcuate fashion alone the slot. Such non-linear deformation is conducive to shortening the life-span of the spring.

Most of the above outlets are designed for two-pronged plugs. Only Belknap illustrates a third ground hole to accommodate three-prong plugs. The standard three-prong plug possesses a ground plug that is substantially longer than the other two plugs. The preferred method of turning the childproofing plate out of the way so that its holes align with the holes of the socket is to insert a plug into the holes of the plate and turn the plate by hand. However, since the ground prong of the three-prong plug is substantially longer than the other two prongs, it is difficult to insert all three prongs into the holes of a plate such as that described in Belknap; the ground prong will enter the ground hole, but the other two prongs will be too short to enter their respective holes. As a result, the plate must be turned by another more cumbersome means, such as by use of fingers alone. Depending on the strength of the biasing means, this procedure can be very difficult.

SUMMARY OF THE INVENTION

Accordingly, it is an object of the invention to provide a childproof surge protector or power strip with an improved biasing system.

It is another object of the invention to provide a childproof surge protector or power strip that enables easy use with three-prong plugs.

It is another object of the invention to provide a childproof surge protector or power strip that overcomes the deficiencies in the art.

It is another object of the invention to provide a surge protector or power strip that can safely be used in a household containing small children.

The above and other objects are achieved by the invention which is a power strip, preferably a surge protector, that includes a housing having a plurality of electrical sockets adapted to receive electrical plugs and at least one conductor connected to the sockets so that power may be supplied to the sockets via the conductor. A plurality of non-conductive plates are disposed in front of the electrical sockets, each of the plates having a set of holes corresponding to the socket-holes of the electrical sockets. A plurality of biasing springs are attached to the housing and each of the non-conductive plates respectively; the biasing springs are each adapted to bias the non-conductive plates into a first position so that the holes in the plates do not align with the socket-holes of the electrical sockets. The surge protector also includes a nonconductive barrier disposed between the biasing springs and the conductor adapted to electrically isolate the springs from the conductor.

In another embodiment, the invention is a power strip, preferably a surge protector, which includes a housing having a plurality of electrical sockets adapted to receive electrical plugs, and at least one conductor connected to the sockets so that power may be supplied the sockets via the conductor. A plurality of non-conductive plates are disposed in front of the electrical sockets, each of the plates having a set of holes corresponding to the socket-holes of the electrical sockets. A plurality of biasing springs are attached to the housing and each of the non-conductive plates respectively; the biasing springs are adapted to bias the non-conductive plates into a first position so that the holes in the plates do not align with the socket-holes of the electrical sockets. A plurality of recesses are provided which are adapted to receive the plates and allow rotation of the plates therein. The surge protector also includes a plurality of depressions, formed respectively in each of the recesses, each depression in a position corresponding to one of the holes of each of the plates when the plates are in the first position. The plates each may be rotated into a second position in which the holes in the plates align with the socket-holes of the electrical sockets.

By providing a non-conductive barrier between the biasing spring and the electrical connectors of the socket, risk of contact between the spring and the connectors is minimized and so it the risk of shorting the socket with the spring. Moreover, the barrier provides lateral support for the spring and prevents undesirable deformation of the spring, thereby enhancing the lifespan of the spring.

By providing a depression in the recess corresponding to one of the holes in the plate when the plate is in its biased "closed" position, the ground prong may be inserted into the plate deeper than the width of the plate without abutting the housing of the surge protector. The deeper insertion of the ground prong enables the two other prongs to be inserted into the plate as well. With all three prongs insertable into the plate, the plug may easily be used to rotate the plate into its second "open" position.

DETAILED DESCRIPTION OF THE PREFERRED EMBODIMENTS

Figure 1:
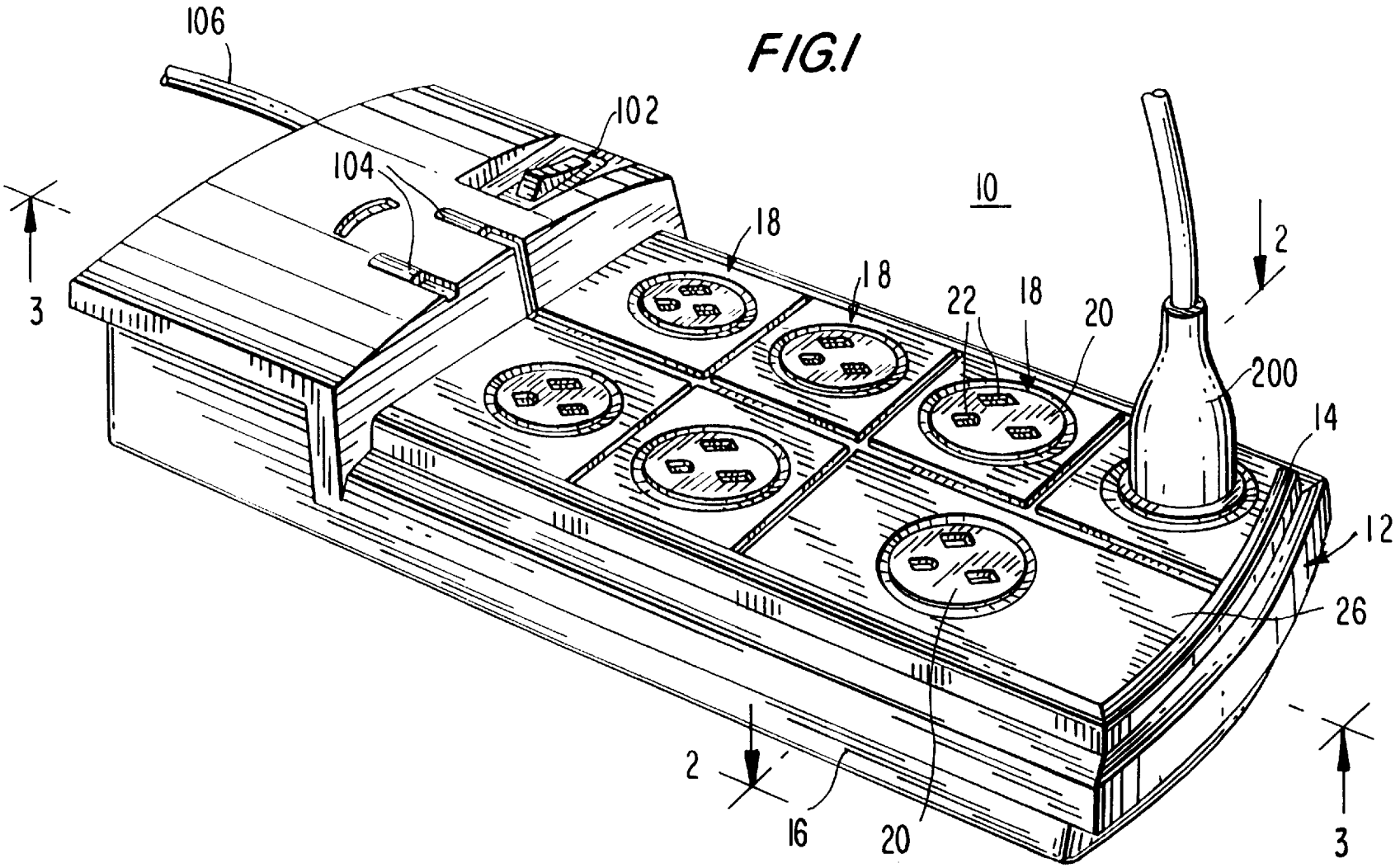
FIG. 1 is a perspective view of a surge protector according to the invention.
Figure 2:
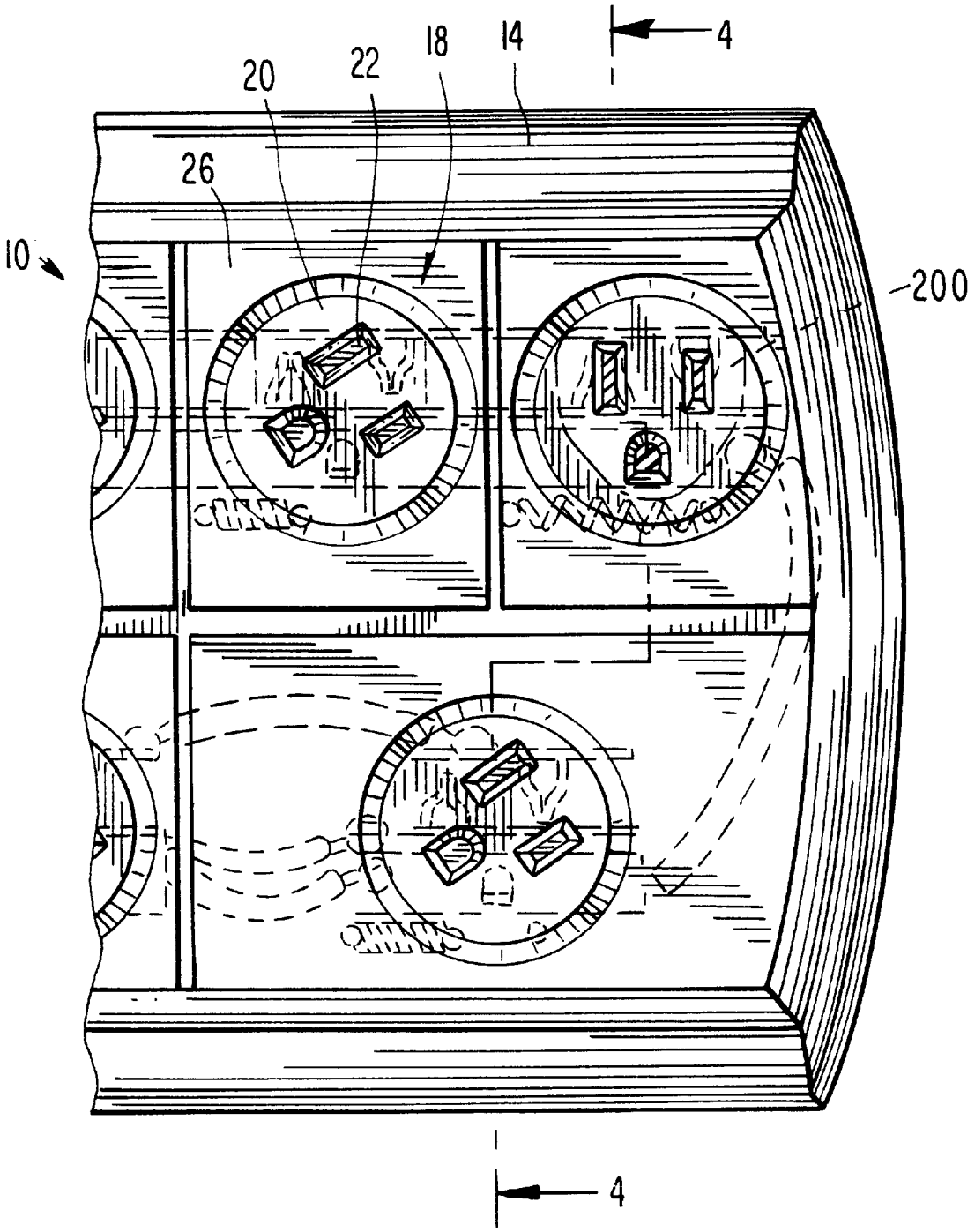
FIG. 2 is a broken top view of the surge protector of FIG. I with the internal structure of the surge protector shown in broken lines, taken along line 2—2 in FIG. 1.

A description of the invention will now be given with reference to FIGS. 1–8. A perspective view of the invention is presented in FIG. 1. Surge protector 10 is provided with non-conductive housing 12, which preferably includes upper housing section 14 and lower housing section 16. A plurality of electrical sockets 18 are formed in upper housing section 14. Disposed in front of sockets 18 are non-conductive plates 20, each provided with holes 22. Holes 22 correspond to the holes of sockets 18 and to the configuration of a standard three-prong electrical plug 200 having power prongs 210 and ground prong 220. In a first position, holes 22 do not line up with the holes of sockets 18 (socket-holes), thereby preventing access to the sockets, in a manner to be described below. Plates 20 are disposed in recesses 24 (see FIG. 5) in which they are allowed to rotate from a closed position to an open position, i.e., from a position in which the plate holes 22 are out of alignment with the sockets to a position in which in plate holes 22 alignment with the sockets. Cover plate 26 is disposed on top of plates 20 and retains plates 20 in recesses 24 while providing access to plates 20 and sockets 18. As best shown in FIG. 5, plates 20 are preferably provided with flanges 21 which engage cover plate 26 when cover plate 26 is secured onto upper housing section 14. Cover plate 26 is preferably provided with rims 27 which engage flanges 21.

Surge protector 10 may also be provided with on/off switch 102, indicator lights 104, and electrical cord 106, all of which are conventional in the art. Other conventional features are shown in FIG. 3, and include reset button 108 and clipping electronics 110 for performing the actual surge protection function.

Figure 3:
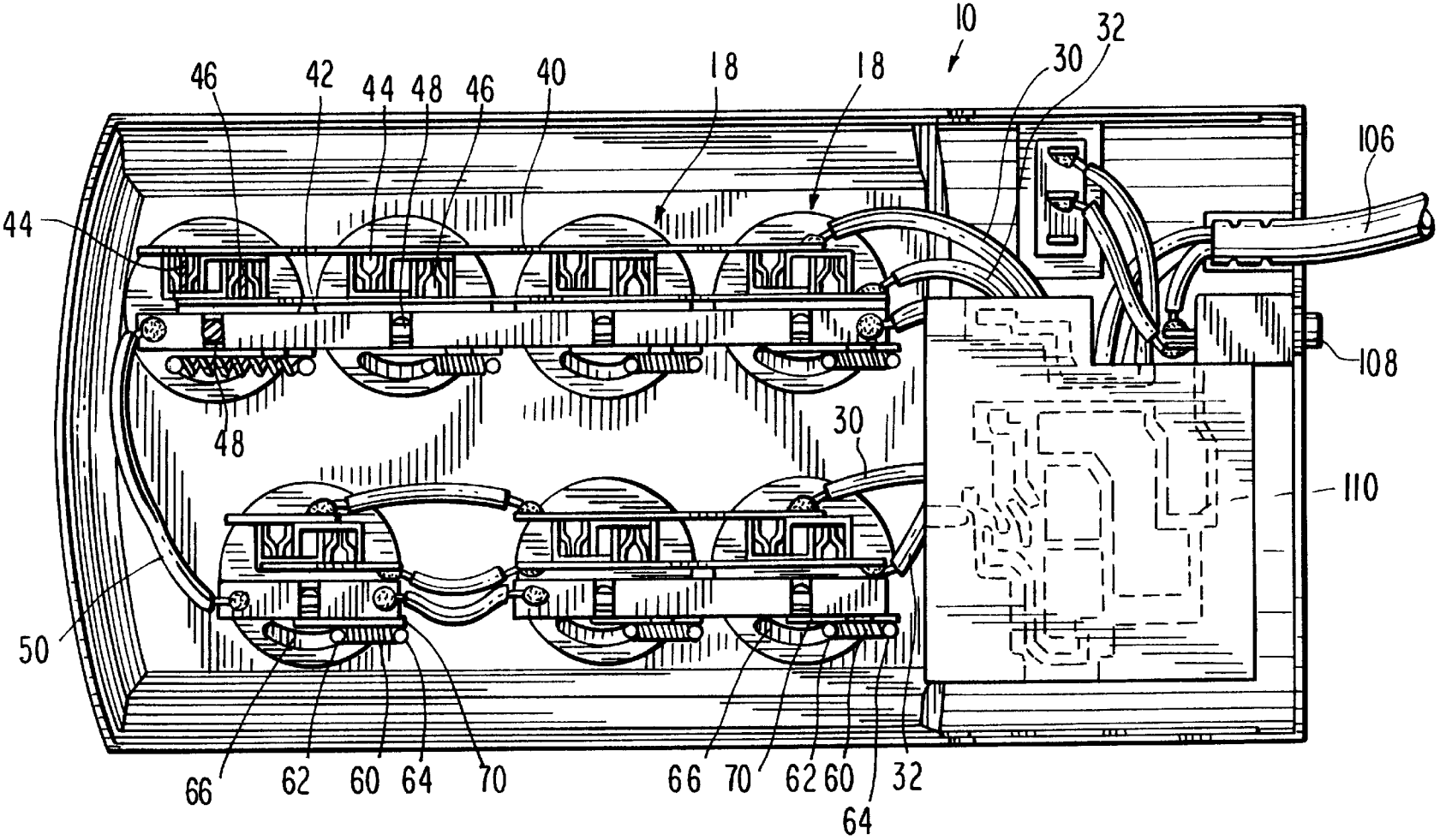
FIG. 3 is a top view of the surge protector of FIGS. I and 2 with the upper half of the housing removed to illustrate the internal structure of the surge protector, taken along the line 3—3 in FIG. 1.
Figure 4:
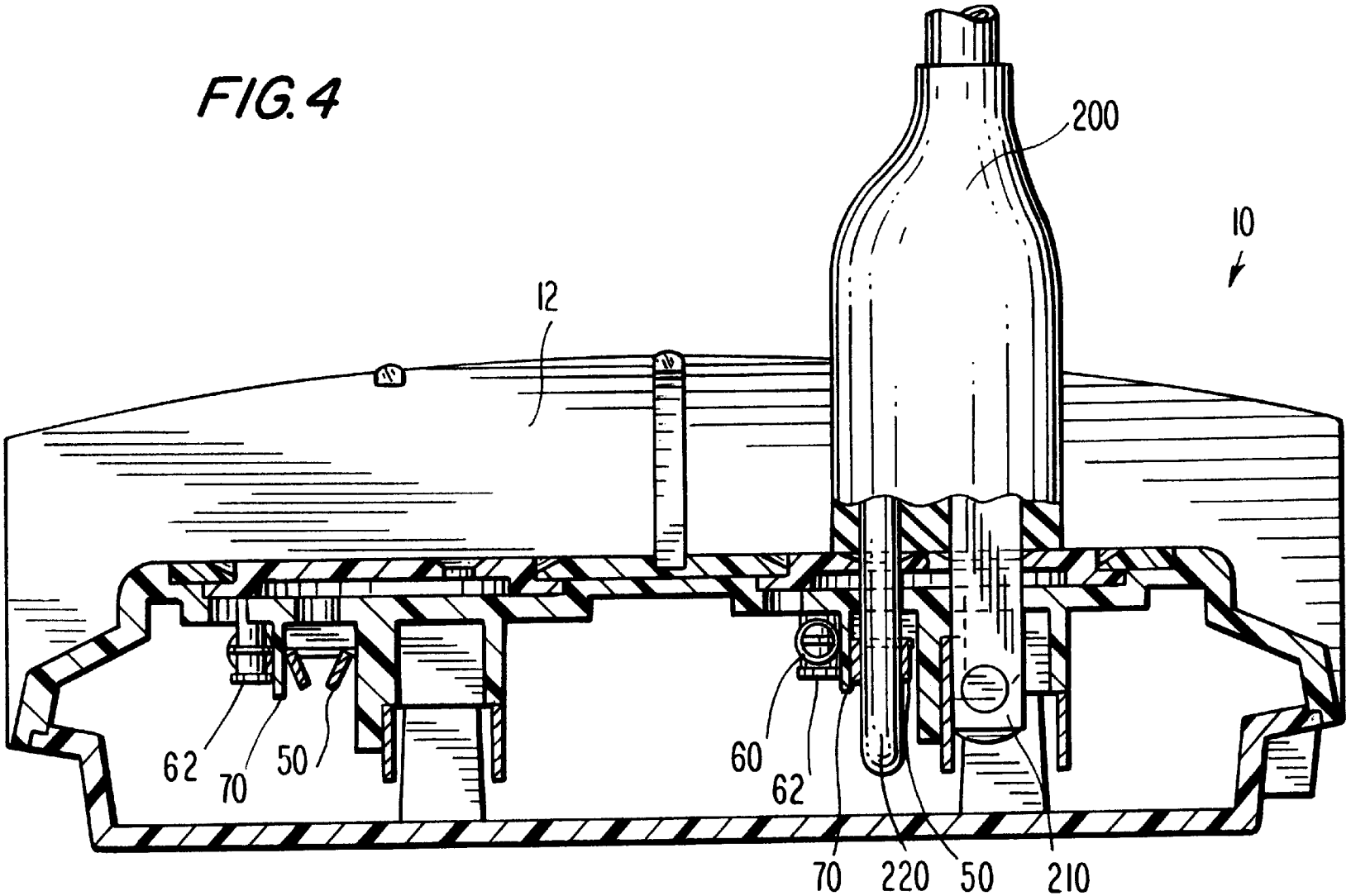
FIG. 4 is a side section view of the surge protector of FIG. 2 taken along the line 4—4 of FIG. 2, showing a plug inserted into a socket.
Figure 5:
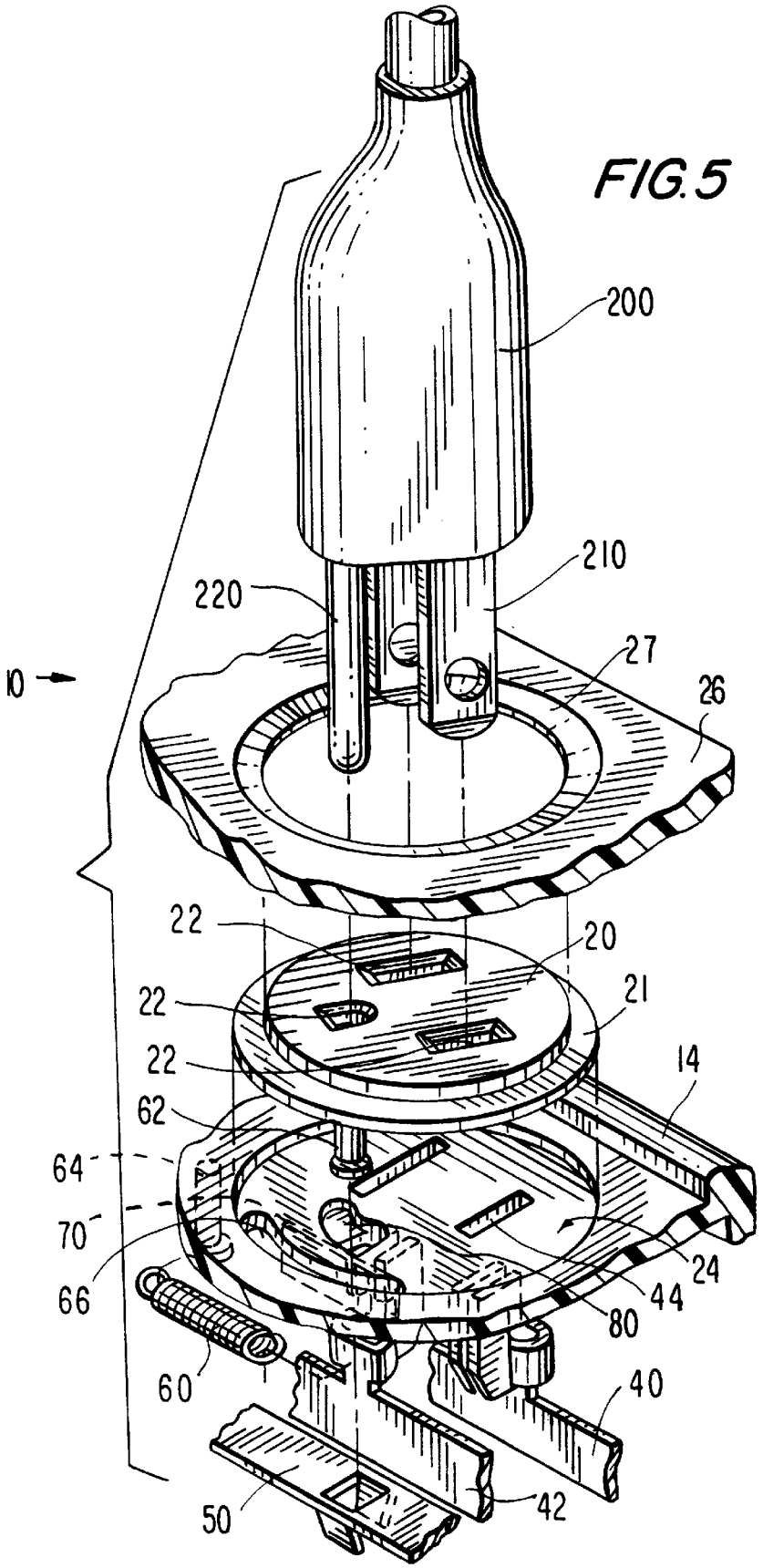
FIG. 5 is an exploded perspective view of one outlet of the surge protector of the previous figures with a plug.

FIGS. 2–5 illustrate the interior of surge protector 10. Power leads 30 and 32 supply sockets 18 with power via common power connectors 40 and 42. Connector 40 supplies holes 44 of the sockets, while connector 42 supplies holes 46 of the sockets. Common ground connector 50 grounds all of holes 48 of sockets 18. As best illustrated in FIGS. 3–5, plate 20 is spring-biased into its first closed position in which plate holes 22 are out of alignment with electric socket holes 44, 46, and 48. Coil spring 60 is attached to pin 62 on plate 20 and mounting post 64 disposed on the underside of upper housing section 14. Pin 62 protrudes through arcuate slot 66 formed in the base of recess 24 so that spring 60 is roughly parallel to the flat underside of upper housing section 14. The force of biasing spring 60 keeps plate 20 fixed in a first position with plate holes 22 out of alignment with socket holes 44, 46, and 48. If it is desired to use an electric socket 18, plate 20 is rotated against the force of the spring, and a prongs 210, 220 of a plug 200 is inserted into socket 18.

When plate 20 is rotated, pin 62 travels along arcuate slot 66. Although the path of the pin is an arc, biasing spring 60 is at no point bent or curved; a straight line always exists between pin 62 and mounting post 64. Thus, little or no unwanted lateral or torsional forces are placed on the coil spring, which is designed for expansion along its longitudinal axis.

The internal structure of the surge protector also includes non-conductive barrier 70, disposed adjacent biasing spring 60. Barrier 70 is interposed between spring 60 and ground conductor 50 to prevent accidental or inadvertent contact between the two. Since biasing spring 60 is preferably metallic, contact between the spring and any of the electrical components of the surge protector would be detrimental to the operation of the device. Barrier 70 effectively prevents such contact. Moreover, in cases where non-standard or non-linear loads might be applied to biasing spring 60, barrier 70 can provide lateral support to the spring and help to prevent lateral deformation of the spring.

As mentioned above, in order for sockets 18 to be used, plate 20 must be rotated so that plate holes 22 align with holes 44, 46, and 48 of socket 18. An easy method of rotating plate 20 is to insert prongs 210 and 220 of plug 200 into plate holes 22 and rotate plug 200. Rotating plug 200 provides good leverage on the plate, by providing three roughly equidistant points of contact, and plate 20 is rotated so as to line up its holes 22 with socket 18.

However, ground prong 220 is longer than power prongs 210. As a result, when one attempts to insert the prongs into plate holes 22, only the ground prong will go in; the two power prongs 210 will be dangling short of the hole, and will not contact the plate. It would be difficult to rotate plate 20 in this fashion, i.e., with only one point of contact.

Thus, as best illustrated in FIG. 5, the invention is provided with depression 80 adjacent ground hole 48 of socket 1hole 2 depression is located on recess 24 where plate hole 22 for the power prong is situated when plate 20 is in the closed safety configuration, out of alignment with socket 18. Depression 80 is a deepened portion of recess 24 provided to allow all three prongs of a plug to be insertable into plate holes 22 at once. When plug 200 is inserted, ground prong 220 enters a hole 22 before power prongs enter 210 owing to ground prong 220 being longer. Ordinarily, the tip of prong 220 would abut the base of recess 24 and further insertion of the plug (i.e., to allow the other two prongs to be inserted into the plate holes to enable the rotation of the plate) would be prevented. According to the present invention, prong 220 enters plate hole 22 and moves into depression 80 so that power prongs 210 are allowed to enter their respective plate holes 22. Three-point contact between plate 20 and plug 200 is achieved, and plate 20 can thus be easily rotated into alignment with socket 18. Depression 80 is preferably at least as deep as the height differential between power prongs 210 and ground prong 220.

Figure 6:
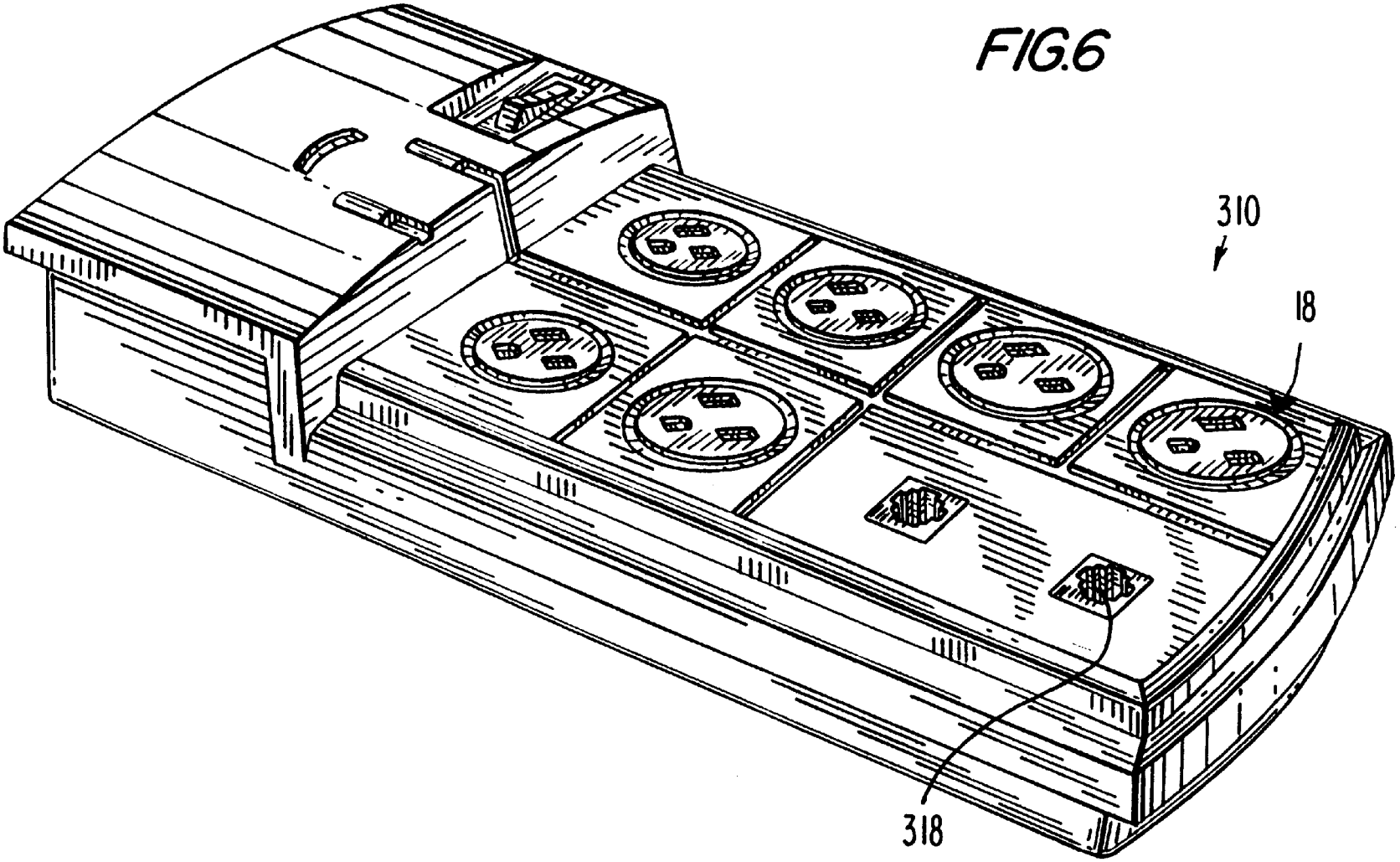
FIGS. 6–8 are perspective views of alternate arrangements of the invention.
Figure 7:
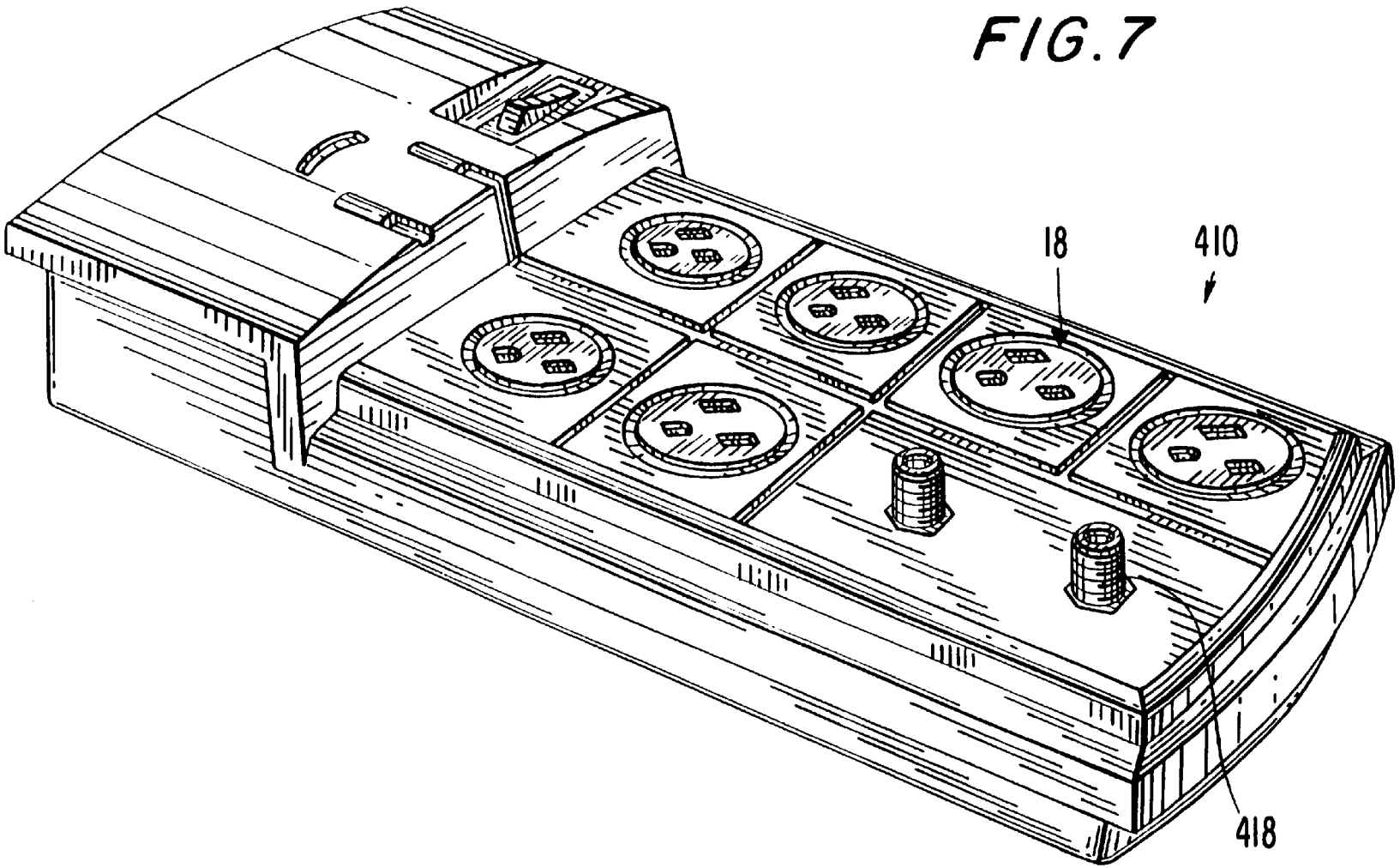
Figure 8:
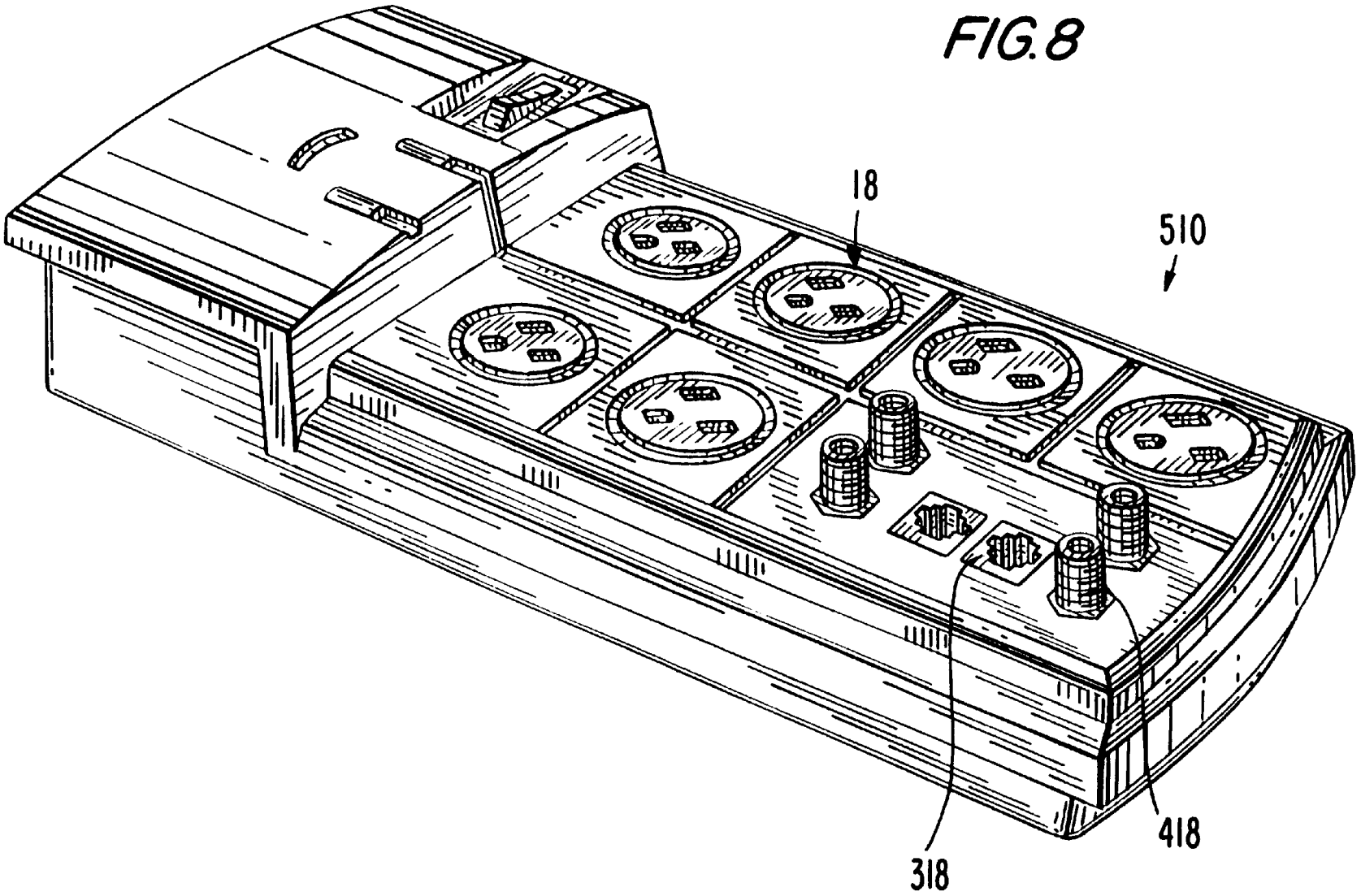

Having described the invention with regard to specific embodiments, it is to be understood that the description is not meant as a limitation excluding such further variations or modifications as may be apparent or may suggest themselves to those skilled in the art. It is intended that the present invention cover such variations and modifications as fall within the scope of the appended claims. For example, the above description makes reference to a surge protector having electrical outlets. However, other types of outlets may be added to the surge protector as shown in FIGS. 6–8. For example, in FIG. 6, surge protector 310 is provided with telephone or modem jacks 318 in addition to electrical sockets 18. In FIG. 7, surge protector 410 is provided with F-connector jacks 418 in addition to electrical sockets 18. Finally, in FIG. 8, both telephone jacks 318 and F-connector jacks 418 are provided in surge protector 510.

Also, the invention is not limited to the precise configuration of electric plug that is currently the standard. Should the standard configuration change, it is contemplated that the invention would still be applicable.

Other modifications are also possible and contemplated as falling within the appended claims. For example, the device is described as a surge protector, however it may also be a power strip providing multiple outlets but no surge protection ability. That is, clipping electronics 110 need not be provided.

What is claimed is:

1. A power strip, comprising:

a housing having a plurality of electrical sockets adapted to receive electrical plugs, said sockets having socket-holes;

at least one conductor connected to said sockets so that power may be supplied to said sockets via said conductor;

a plurality of non-conductive plates, each of said non-conductive plates respectively disposed in front of respective ones of said electrical sockets, each of said non-conductive plates having a set of holes corresponding to said socket-holes of said electrical sockets;

a plurality of biasing springs each attached to said housing and each of said non-conductive plates respectively, said biasing springs each adapted to bias said non-conductive plates into a first position so that said holes in said non-conductive plates do not align with said socket-holes of said electrical sockets; and a plurality of depressions, formed respectively in each of said sockets, each depression in a position corresponding to one of said holes of each of said non-conductive plates when said non-conductive plates are in said first position wherein said non-conductive plates each may be rotated into a second position in which said holes in said non-conductive plates align with said socket-hole of said electrical sockets.

2. A power strip according to claim 1, said housing further comprising:

a plurality of recesses adapted to receive said non-conductive plates and allow rotation of said non-conductive plates therein; and a non-conductive barrier disposed between said biasing springs and said conductor adapted to electrically isolate said springs from said conductor.

3. A power strip according to claim 2, further comprising:

a plurality of pins each disposed on each one of said non-conductive plates, respectively;

a plurality of arcuate slots formed in said recesses adapted to receive said pins; and mounting posts each formed on said housing near each of said recesses, wherein a first end of each of said biasing springs is connected to each of said mounting posts and a second end of each of said biasing springs is connected to each of said pins.

4. A power strip according to claim 3, wherein each of said arcuate slots are formed on one side of said non-conductive barrier and said conductor is disposed on an opposite side of said barrier.

5. A power strip according to claim 3, wherein said sockets each comprise three sockets-holes, wherein said conductor comprises three conductors common to all of said sockets, each of said conductors being electrically connected to one of said socket-holes of all of said sockets.

6. A power strip according to claim 5, wherein each of said arcuate slots are formed on one side of said non-conductive barrier and said conductors are disposed on an opposite side of said barrier.

7. A power strip according to claim 4, wherein said biasing springs comprise coil springs and, when said non-conductive plates are rotated into said second position, said biasing springs expand linearly respectively along longitudinal axes of said springs.

8. A power strip according to claim 5, wherein said biasing springs comprise coil springs and, when said non-conductive plates are rotated into said second position, said biasing springs expand linearly respectively along longitudinal axes of said springs.

9. A power strip according to claim 5, wherein said three socket-holes of each socket correspond to a standard three-prong electric plug with one of said socket-holes corresponding to a ground prong of the standard three-prong electric plug, wherein said depressions are formed respectively in each of said sockets adjacent said ground-prong-corresponding socket-hole, each depression in a position corresponding to one of said holes of each of said non-conductive plates when said non-conductive plates are in said first position.

10. A power strip according to claim 9, wherein said depressions are respectively adapted to enable partial insertion of all three prongs of the standard three-prong electric plug into said non-conductive plates when said non-conductive plates are in said first position to thereby facilitate rotation of said non-conductive plates from said first position to said second position.

11. A power strip according to claim 1, wherein said non-conductive plates and said sockets are arranged in more than one row.

12. A power strip according to claim 3, wherein said non-conductive plates, said recesses, and said sockets are arranged in more than one row.

13. A power strip according to claim 5, wherein said non-conductive plates, said recesses, and said sockets are all arranged in more than one row, and wherein each row is provided with its own set of said three conductors.

14. A power strip according to claim 1, wherein said power strip is a surge protector.

15. A power strip, comprising:

a housing having a plurality of electrical sockets adapted to receive electrical plugs, said sockets having socket-holes;

at least one conductor connected to said sockets so that power may be supplied to said sockets via said conductor;

a plurality of non-conductive plates respectively disposed in front of said electrical sockets, each of said non-conductive plates having a set of holes corresponding to said socket-holes of said electrical sockets;

a plurality of biasing springs each attached to said housing and each of said non-conductive plates respectively, said biasing springs each adapted to bias said non-conductive plates into a first position so that said holes in said non-conductive plates do not align with said socket-holes of said electrical sockets;

a plurality of recesses adapted to receive said non-conductive plates and allow rotation of said non-conductive plates therein; and a plurality of depressions, formed respectively in each of said sockets, each depression in a position corresponding to one of said holes of each of said non-conductive plates when said non-conductive plates are in said first position, wherein said non-conductive plates each may be rotated into a second position in which said holes in said non-conductive plates align with said socket-holes of said electrical sockets.

16. A power strip according to claim 15, wherein each of said sockets comprises sockets-holes corresponding to a standard three-prong electric plug with one of said sockets-holes corresponding to a ground prong of the standard three-prong electric plug, wherein said depressions are formed respectively in each of said recesses adjacent said ground-prong-corresponding socket-hole.

17. A power strip according to claim 16, wherein said depressions are respectively adapted to enable partial insertion of all three prongs of the standard three-prong electric plug into said non-conductive plates when said non-conductive plates are in said first position to thereby facilitate rotation of said non-conductive plates from said first position to said second position.

18. A power strip according to claim 15, wherein said power strip is a surge protector.

* * * * *